US008424465B2

(12) United States Patent
Florendo, Jr.

(10) Patent No.: US 8,424,465 B2
(45) Date of Patent: Apr. 23, 2013

(54) SLANT BOARD

(76) Inventor: Epifanio Villanueva Florendo, Jr., Vancouver (CA)

( * ) Notice: Subject to any disclaimer, the term of this patent is extended or adjusted under 35 U.S.C. 154(b) by 0 days.

(21) Appl. No.: 13/210,660

(22) Filed: Aug. 16, 2011

(65) Prior Publication Data

US 2012/0210912 A1 Aug. 23, 2012

Related U.S. Application Data

(60) Provisional application No. 61/374,502, filed on Aug. 17, 2010.

(51) Int. Cl.
*A47F 5/12* (2006.01)

(52) U.S. Cl.
USPC ..... 108/9; 248/456

(58) Field of Classification Search ..... 108/1, 6, 108/7, 9; 248/455, 456, 441.1, 454, 457, 248/460, 463, 465; 281/33
See application file for complete search history.

(56) References Cited

U.S. PATENT DOCUMENTS

| | | | | | |
|---|---|---|---|---|---|
| 244,306 | A | * | 7/1881 | Rawson | 108/9 |
| 1,203,659 | A | * | 11/1916 | Smith | 248/456 |
| 1,564,594 | A | * | 12/1925 | Leh | 248/448 |
| 2,219,091 | A | | 10/1940 | Henderson | |
| 2,374,409 | A | | 4/1945 | Brennan | |
| 3,562,796 | A | * | 2/1971 | Jacobson | 248/456 |
| 3,991,967 | A | | 11/1976 | Sack | |
| 4,323,214 | A | | 4/1982 | DeLuca | |
| 4,460,146 | A | * | 7/1984 | Raggiotti | 248/456 |
| 4,592,285 | A | * | 6/1986 | Egli | 108/9 |
| 4,618,119 | A | | 10/1986 | Powell | |
| 5,035,393 | A | * | 7/1991 | Menaged | 248/456 |
| 3,381,928 | A | | 7/1995 | White | |
| 5,433,415 | A | | 7/1995 | Samson et al. | |
| 5,651,525 | A | | 7/1997 | Yang | |
| 5,797,578 | A | * | 8/1998 | Graffeo et al. | 248/453 |
| 5,915,661 | A | * | 6/1999 | Silverman et al. | 248/465.1 |
| 6,293,591 | B1 | | 9/2001 | Pecci | |
| 6,663,073 | B1 | * | 12/2003 | Church | 248/458 |
| D521,562 | S | | 5/2006 | Richter | |
| 8,205,561 | B1 | * | 6/2012 | Bierworth | 108/9 |
| 2003/0001064 | A1 | * | 1/2003 | Book | 248/460 |
| 2003/0019996 | A1 | | 1/2003 | Shields | |
| 2003/0029985 | A1 | | 2/2003 | Zeller et al. | |
| 2007/0075208 | A1 | | 4/2007 | Chen | |
| 2007/0221811 | A1 | | 9/2007 | Hauser et al. | |
| 2008/0142668 | A1 | | 6/2008 | Rickards | |

FOREIGN PATENT DOCUMENTS

| | | |
|---|---|---|
| FR | 69.24120 | 10/1970 |

* cited by examiner

*Primary Examiner* — Jose V Chen
(74) *Attorney, Agent, or Firm* — Oyen Wiggs Green & Mutala LLP

(57) ABSTRACT

A slant board for viewing, reading, or working an object at a convenient angle is provided. The slant board includes a table. The table includes an inner face, an outer face, and a plurality of struts, each strut pivotally coupled to the inner face along respective lateral pivot axes. The slant board also includes a base pivotally coupled to the table to define a tilt angle therebetween. The base includes a plurality of stops for engaging the struts. At least two struts have different lateral pivot axes and/or different lengths. Each of the plurality of struts is engageable with at least one of the plurality of stops to provide a range of tilt angles.

15 Claims, 12 Drawing Sheets

SLANT BOARD

TECHNICAL FIELD

This invention relates to a slant board for viewing, reading, or working an object at a convenient angle.

BACKGROUND

Viewing, reading or working an object on an angled rather than horizontal surface is ergonomically beneficial. Hands-free retention of the object being read, viewed or worked is also ergonomically beneficial and further frees the hands to attend to other tasks. Slant boards, with and without hands-free object retention, are generally known in the art. Deficiencies of known slant boards include their complexity, weight, costliness, lack of stability, and limited range of adjustable angles if any.

The present invention provides a simple, lightweight, inexpensive, stable, slant board for viewing, reading, or working an object on a surface with a broad and incrementally adjustable range of angles.

SUMMARY

In one aspect of the invention a slant board is provided. The slant board includes a table. The table includes an inner face, an outer face, and a plurality of struts, each strut pivotally coupled to the inner face along respective lateral pivot axes. The slant board also includes a base pivotally coupled to the table to define a tilt angle therebetween. The base includes a plurality of stops for engaging the struts. At least two struts have different lateral pivot axes and/or different lengths. Each of the plurality of struts is engageable with at least one of the plurality of stops to provide a range of tilt angles.

The outer face may include a shelf at a proximal end thereof.

The slant board may include a first strut, a second strut having a length greater than the first strut; and a third strut having a length greater than the second strut. A lateral pivot axis of the first strut may be disposed at a distal region of the inner face, a lateral pivot axis of the third strut may be disposed proximally of the lateral pivot axis of the first strut, and a lateral pivot axis of the second strut may be disposed proximally of the lateral pivot axis of the third strut. The second strut may be nestable within the third strut.

The inner face may include at least one recess for stowing the struts. The at least one recess may include magnets for releasably engaging the struts.

The table and the base may be of substantially similar size and dimension. The table and the base may be made of molded plastic.

The plurality of stops may include laterally elongated grooves. The plurality of stops may be disposed in a recess in the base.

The shelf may include a pair of retaining arms. The pair of retaining arms may be rotatable, telescopable and inwardly biased.

Another aspect of the invention provides a slant board. The slant board includes a first board. The first board includes an inner face, an outer face having a shelf at a proximal region thereof, and a plurality of struts, each strut pivotally coupled to the inner face along respective lateral pivot axes. The slant board also includes a second board pivotally coupled to the first board to define a tilt angle therebetween, the second board including a plurality of stops for receiving the struts. At least two struts have different lateral pivot axes and/or different lengths. Each of the plurality of struts is engageable with at least one of the plurality of stops to provide a range of tilt angles.

The slant board may include a first strut, and a second strut having a length greater than the first strut. A lateral pivot axis of the first strut may be distal to a lateral pivot axis of the second strut.

A further aspect of the invention provides a slant board. The slant board includes a table. The table includes an inner face, an outer face comprising a shelf at a proximal end thereof, a first U-shaped strut, a second U-shaped strut having a length greater than the first strut, and a third U-shaped strut having a length greater than the second strut. Each strut is pivotally coupled to the inner face along respective lateral pivot axes. A lateral pivot axis of the first strut is disposed at a distal region of the inner face, a lateral pivot axis of the third strut is disposed proximally of the lateral pivot axis of the first strut, and a lateral pivot axis of the second strut is disposed proximally of the lateral pivot axis of the third strut. The second strut is nestable within the third strut. The inner face includes at least one recess for stowing the struts. The at least one recess includes means for releasably engaging the struts. The table also includes a base pivotally coupled to the table to define a tilt angle therebetween. The base includes a plurality of laterally elongated grooves for engaging the struts. The table and the base are of substantially similar size and dimension. The table and the base are made of blow-molded plastic. Each of the struts is engageable with at least one of the plurality of laterally elongated grooves to provide a range of tilt angles.

The slant board may have a range of tilt angles ranging from about 5 degrees by engaging the first strut to one of the plurality of laterally elongated grooves to about 55 degrees by engaging the third strut to another one of the plurality of laterally elongated grooves.

The inner face of the table and an outer face of the base may be dimpled.

BRIEF DESCRIPTION OF DRAWINGS

In drawings which show non-limiting embodiments of the invention.

DESCRIPTION

Figure 1:
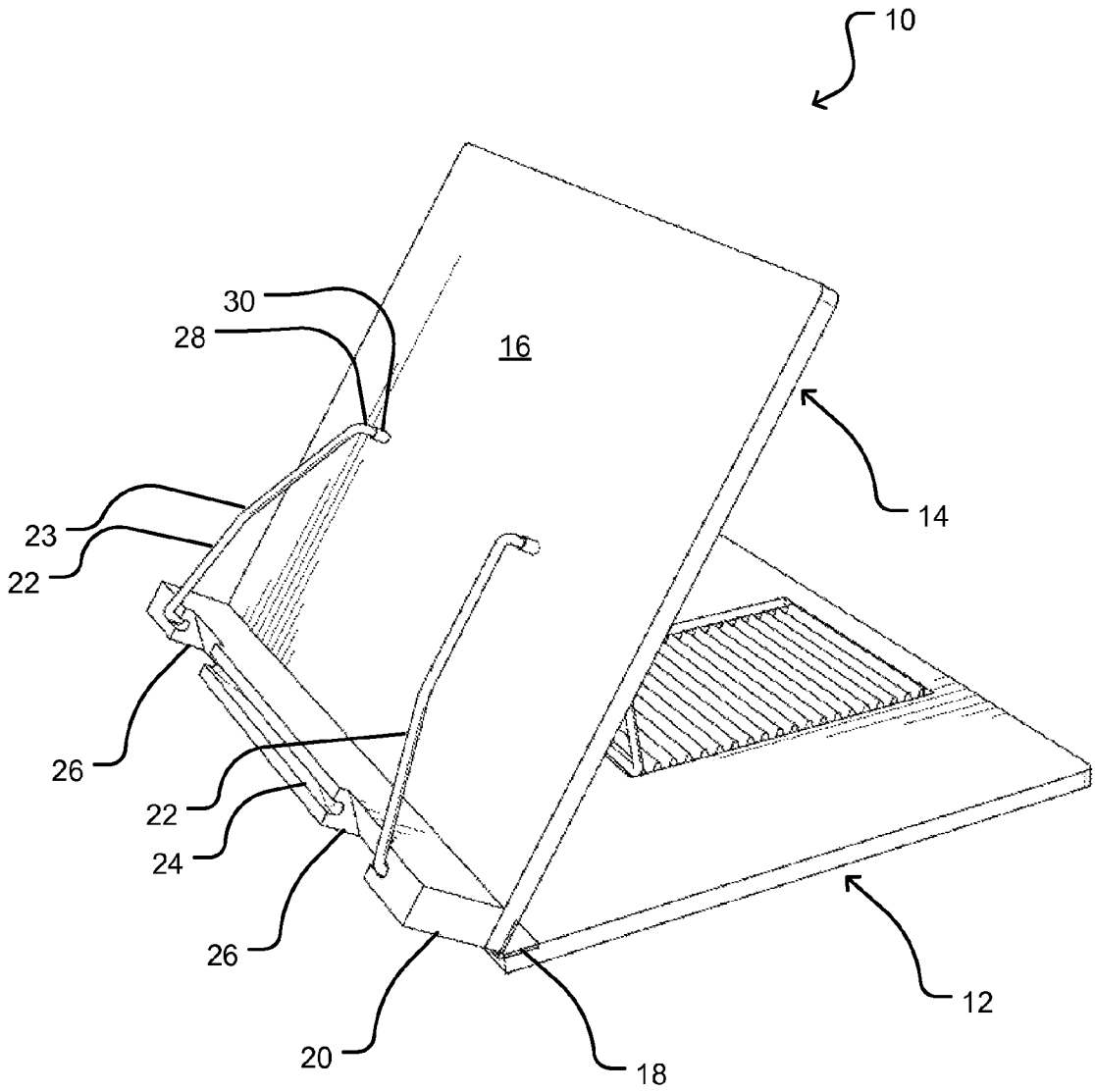
FIG. 1 is a front perspective view of a slant board in a fully deployed configuration according to one embodiment of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The term "slant board" as used in this specification includes any support, stand, lifter, angler, holder and similar apparatus for supporting a broad range of objects for viewing, reading, and/or working. Objects supported on the slant board may include print publications (e.g. books, magazines), documents, electronic devices (e.g. tablet computers, e-books, portable DVD players, digital photo viewers, personal digital assistants, smartphones), notebooks, writing pads, sketch pads and the like.

The terms "proximal" and "distal" as used in this specification, refer to positions relatively closer to and relatively farther from, respectively, the pivotally coupled ends of the base and the table of the slant board. The terms "lateral" and "longitudinal", as used in this specification, refer to orientations parallel and perpendicular, respectively, to the pivotally coupled ends of the base and the table of the slant board. The terms "inwardly" and "outwardly", as used in this specification, refer to positions relatively closer to and relatively farther from, respectively, the slant board.

The invention relates to a slant board configurable between a collapsed configuration and a plurality of deployed configurations. In each deployed configuration, one of a plurality of struts of a table of the slant board engages one of a plurality of stops of a base of the slant board to selectively orient the table at a tilt angle for supporting an object being viewed, read and/or worked. The various combinations in which the plurality of struts can engage the plurality of stops permit the table to be oriented over a wide range of incrementally adjustable tilt angles.

FIGS. 1 to 6 show a slant board 10 according to one embodiment of the invention. Slant board 10 includes a base 12 and a table 14. Base 12 and table 14 are pivotally coupled. Base 12 may be pivotally coupled to table 14 by any known means. In the illustrated embodiment, base 12 and table 14 are pivotally coupled by a piano hinge 18. In yet other embodiments the base and table may be a live hinge, i.e., integrally formed and flexible along a thin common edge where the base and table join. In yet other embodiments, the base and table may be pivotally coupled by non-hinge means such as a pivot pin/pivot slot.

Base 12 serves to rest on any supporting surface such as user's lap, a desk top, a table top, and the like. The outer face of base 12 may be provided with anti-slip means such as rubberized foam strips and the like. Table 14 has a generally flat outer face 16 against which the back of an object being supported by slant board 10 may rest. Base 12 and table 14 are generally planar, rectangular, and correspond in dimensions. In other embodiments the base and table may be of any generally planar shape (provided they can be pivotally coupled) and may or may not be similar in dimensions. Base 12 and table 14 may be made of any material suitable for supporting an object. In some embodiments, the base and table may be made of a versatile, lightweight and inexpensive material such as blow-molded plastic (e.g. high density polyethylene or polymethyl methacrylate).

Figure 2:
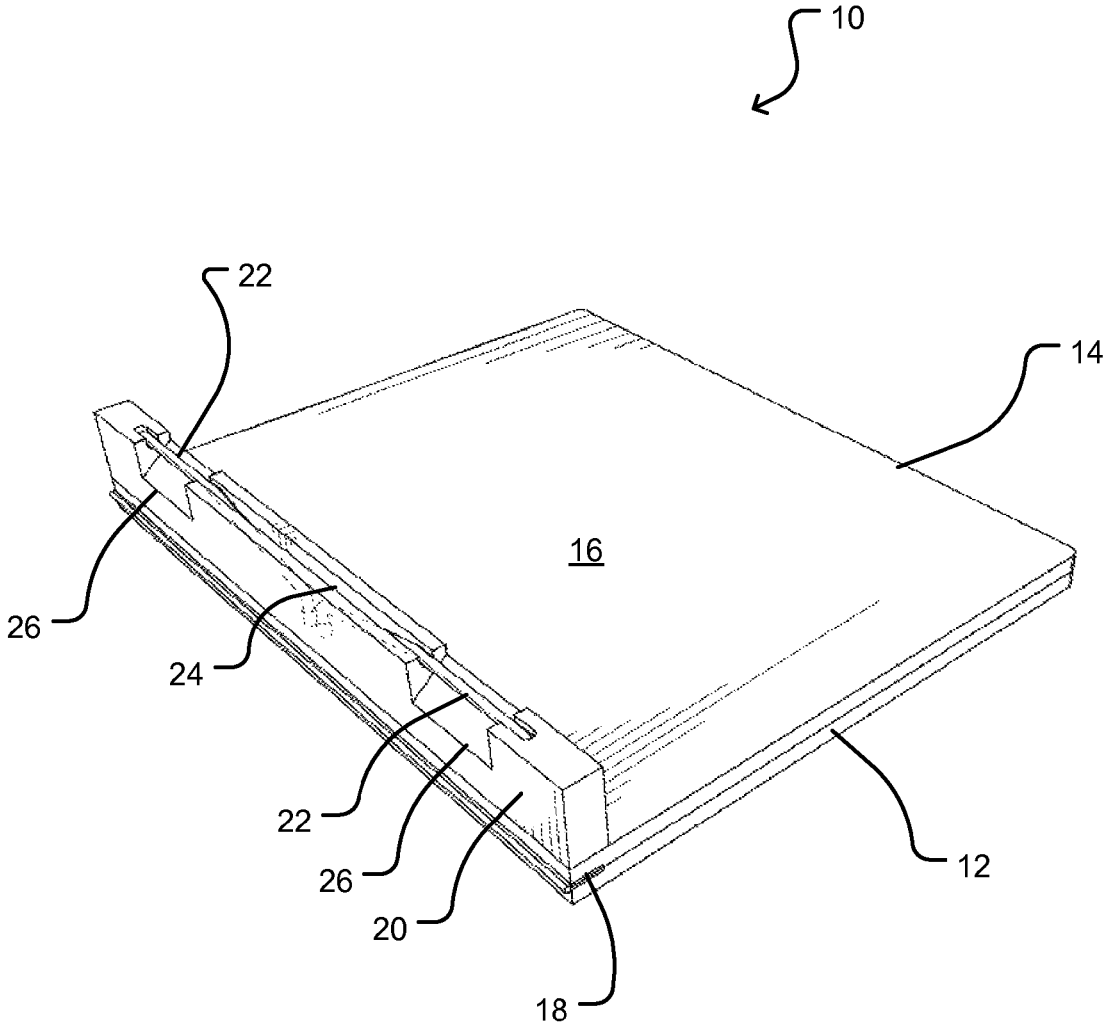
FIG. 2 is a front perspective view of a slant board in a collapsed configuration according to the embodiment shown in FIG. 1.

FIG. 1 shows slant board 10 in a fully deployed configuration with table 14 oriented at a tilted angle with respect to base 12. FIG. 2 shows slant board 10 in a collapsed configuration, with table 14 pivoted to a substantially parallel and closely overlying position with respect to base 12.

Table 14 has a shelf 20 projecting from a proximal region of outer face 16 for supporting an object on slant board 10. Shelf 20 is a narrow, elongated rectangular element in the illustrated embodiment. In other embodiments the shelf may be of any shape and dimension suitable for supporting the object on the slant board. Some embodiments may be provided with a pivotable shelf that can be stowed against the outer face of the table, or stowed within a recess of the outer face of the table, and then deployed by pivoting outwardly when the slant board is in use. Shelf 20 is formed separately from and fixed to table 14. In other embodiments the shelf may be formed integrally with the table.

Shelf 20 houses a pair of retaining arms 22 for holding an object on slant board 10. Retaining arms 22 may, for example, be used to hold down pages of an opened book on slant board 10. Retaining arms 22 are made of lightweight, 9/64" diameter metal rods, but in other embodiments may be made of any material of comparable stiffness and strength. Retaining arms 22 have a narrow diameter to minimize obstructing visual and manual access to the object on slant board 10. Retaining arms 22 may be stowed in a slot 24 formed in shelf 20, as shown in FIG. 2.

Retaining arms 22 are outwardly telescopable when pulled by a user but are biased to telescope inwardly by biasing means (not shown) such as a spring return or the like. Outwardly telescoped retaining arms 22 are rotatable, i.e, arcuately adjustable. Cutouts 26 in shelf 20 facilitate manually grasping of retaining arms 22. Fingers 28 are provided at the ends of retaining arms 22. The ends of fingers 28 may be provided with anti-slip covers 30 to facilitate gripping contact between fingers 28 and the object. Anti-slip covers 30 may for example be coated with a high friction material such as rubber and vinyl and/or may have a textured surface. Retaining arms 22 bend inwardly at elbow 23 toward table 14 to strengthen the contact between fingers 28 and the object being held. In other embodiments, the retaining arms may be shaped differently than in the illustrated embodiment. Other embodiments may have one or more than two retaining arms. Some embodiments may have resilient clips or the like instead of retaining arms. In yet other embodiments, retaining arms, resilient clips and the like may be absent altogether.

Figure 3:
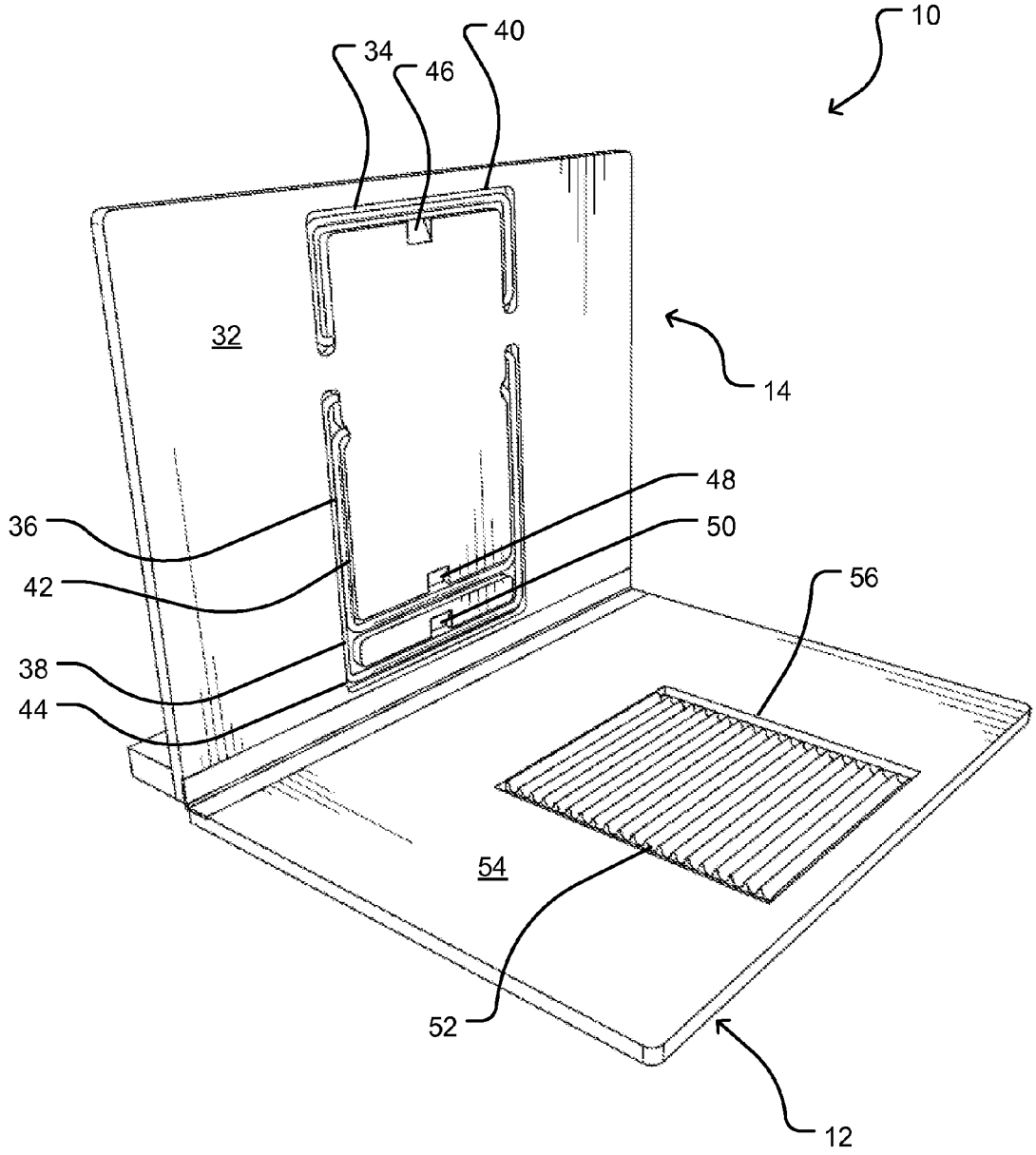
FIG. 3 is a back perspective view of a slant board in a partially deployed configuration according to the embodiment shown in FIG. 1.

As shown in FIG. 3, a plurality of struts 34, 36, 38 are pivotally coupled to inner face 32 of table 14. Pivotal coupling may be by an known pivot or hinge means. In the illustrated embodiment, opposing bent ends of the struts serve as pivot pins that engage corresponding holes (not shown) in the side walls of the recesses.

While the illustrated embodiment has three struts, other embodiments may have two struts or more than three struts. As shown in FIG. 3, strut 36 nests inside strut 38. In other embodiments, none, some, or all of the struts may be arranged in nested relationships. Arranging the struts in nested relationships permits a greater number of struts to be coupled to the table.

Struts 34, 36, 38 are "U"-shaped. Struts 34, 36, 38 may be stowed in correspondingly shaped and dimensioned recesses 40, 42, 44 formed in inner face 32. In other embodiments, the struts may be of any other shape and dimension that can pivotally couple with the inner face of the table and engage with stops (described below) on the base. For example struts may be shaped as a "T", an "I", an "H", an "M", a polygon (e.g. quadrilateral), and the like, with correspondingly shaped and/or dimensioned recesses formed in the inner face of the table and with correspondingly shaped and/or dimensioned stops on the base. Struts 34, 36, 38 may be made of lightweight 9/64" diameter metal rods or any other material of sufficient strength for supporting the weight of table 14 and the object placed on slant board 10.

In the illustrated embodiment, strut 34 swings out of its stowed position in a proximal direction while struts 36 and 38 swing out of their respective stowed positions in a distal direction. In other embodiments, different numbers of struts may swing out in the proximal and distal directions. In yet other embodiments, all of the struts may swing out in a proximal or distal direction.

A plurality of stops 52 are provided along the longitudinal extent of inner face 54. In the illustrated embodiment, stops 52 are a continuous series of laterally elongated grooves. In other embodiments the stops may be provided in any shape or arrangement suitable for releasably engaging the struts. The stops may for example be ribs, projections, notches, clips and the like. The stops may for example be spaced apart rather than arranged in a continuous series.

Stops 52 are disposed in a recess 56 formed in inner face 54. When struts 34, 36, 38 are stowed in recesses 40, 42, 44, slant board 10 can fold flat as shown in FIG. 2.

Figure 4:
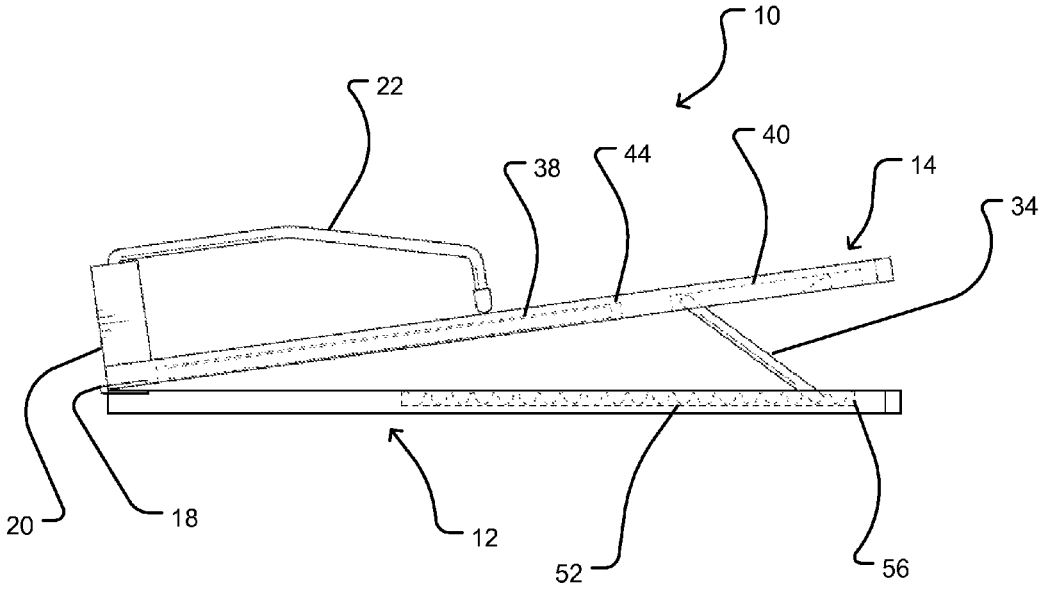
FIG. 4 is a side view of a slant board fully deployed at a low tilt angle according to the embodiment shown in FIG. 1.
Figure 5:
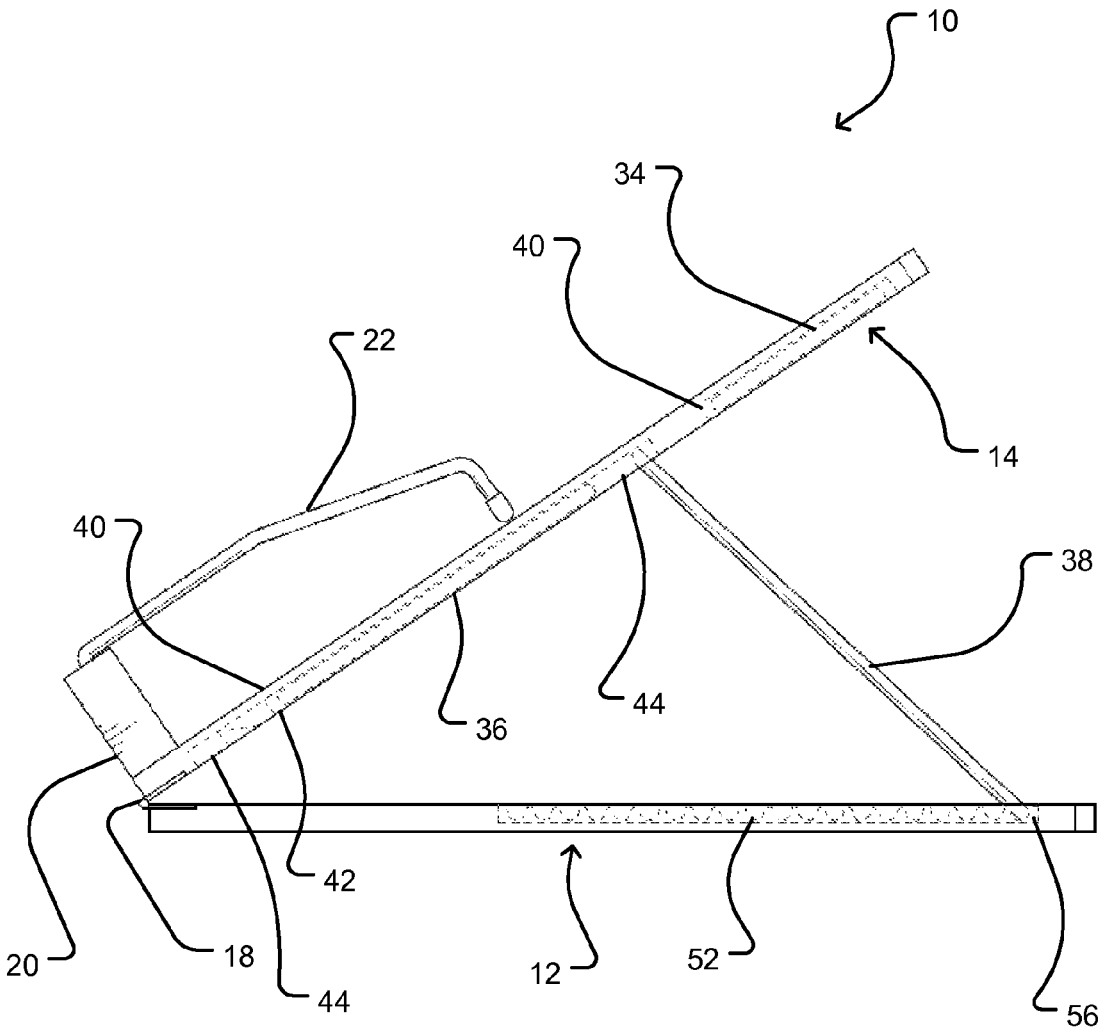
FIG. 5 is a side view of a slant board fully deployed at a medium tilt angle according to the embodiment shown in FIG. 1.
Figure 6:
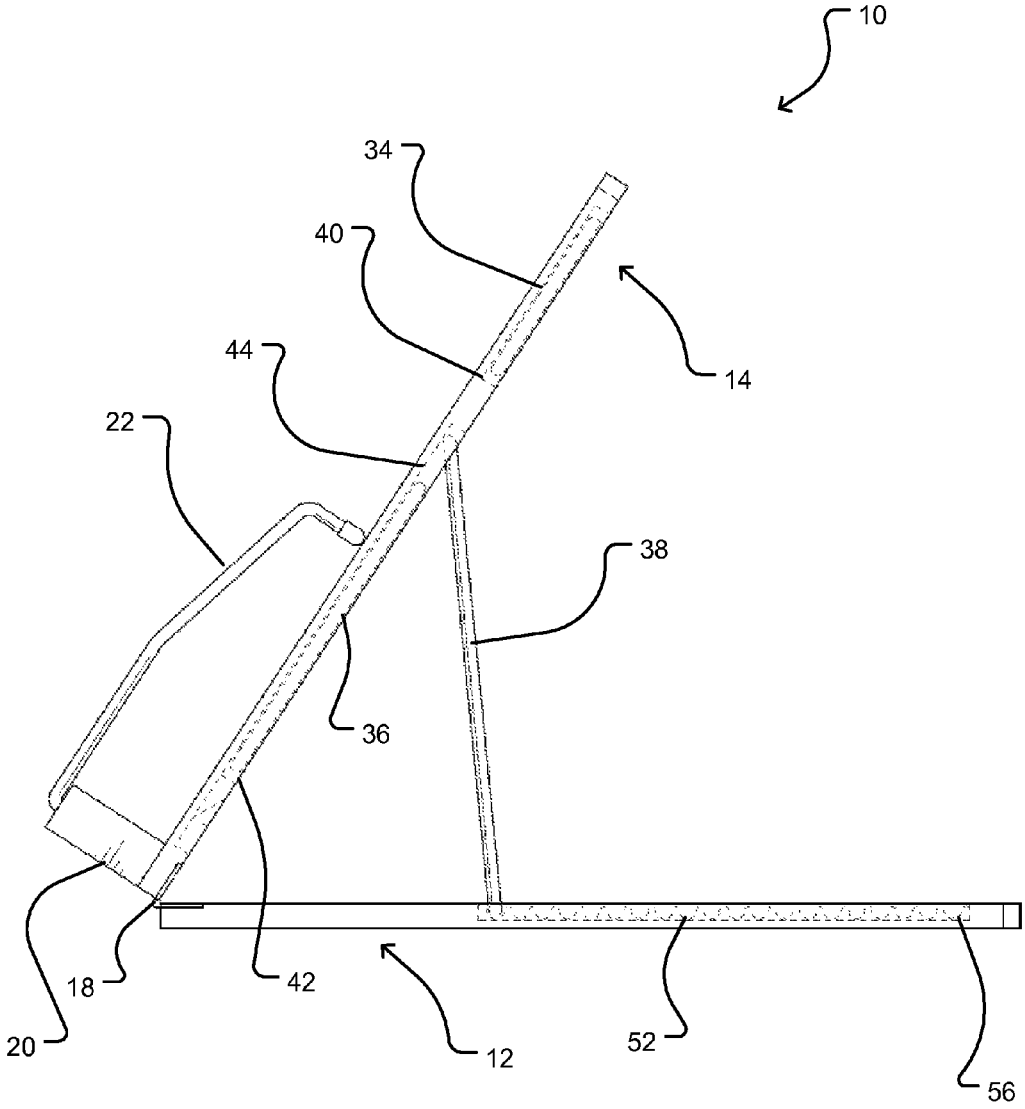
FIG. 6 is a side view of a slant board fully deployed at a high tilt angle according to the embodiment shown in FIG. 1.
Figure 7:
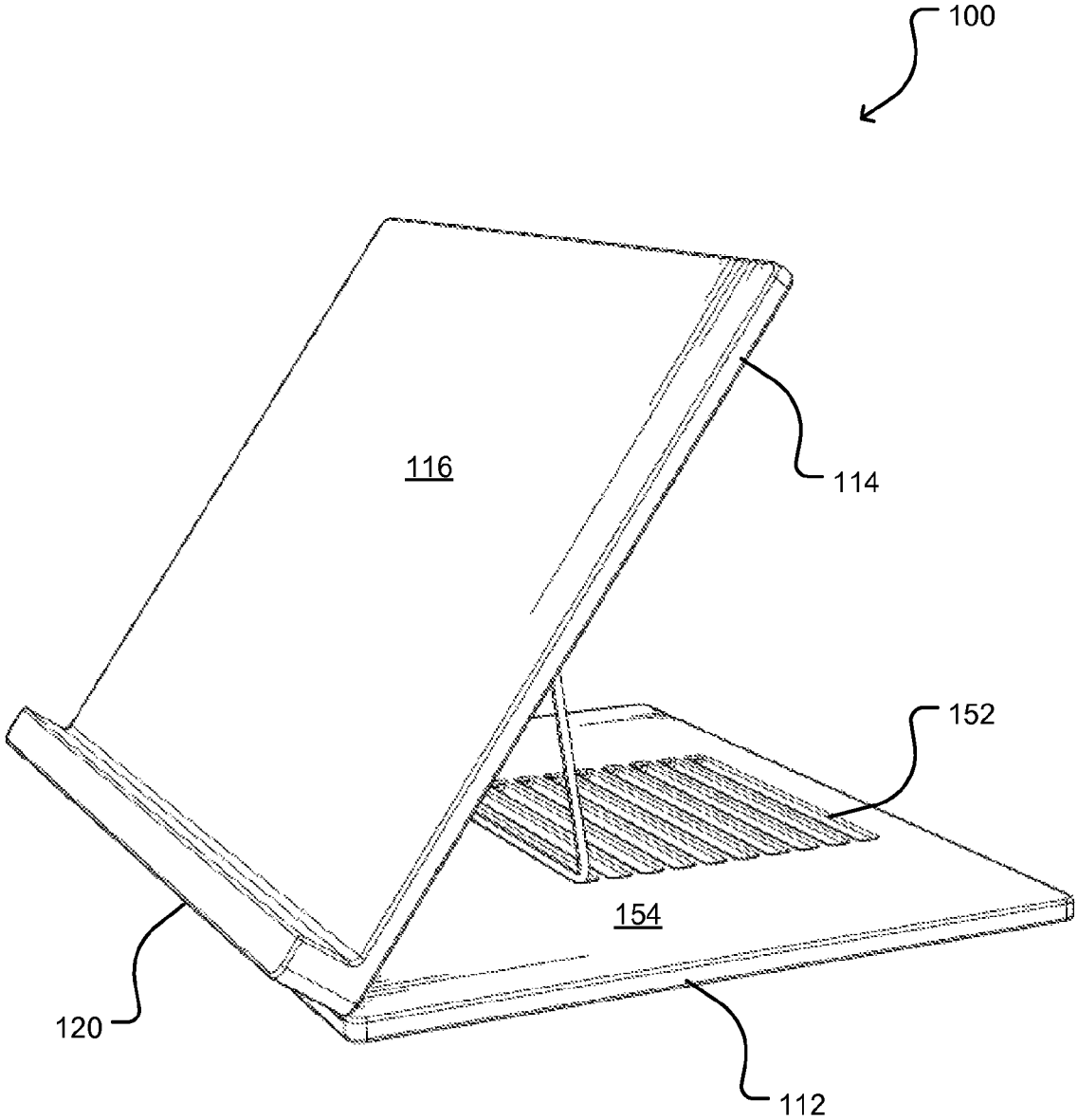
FIG. 7 is a front perspective view of a slant board in a fully deployed configuration according to another embodiment of the invention.
Figure 8:
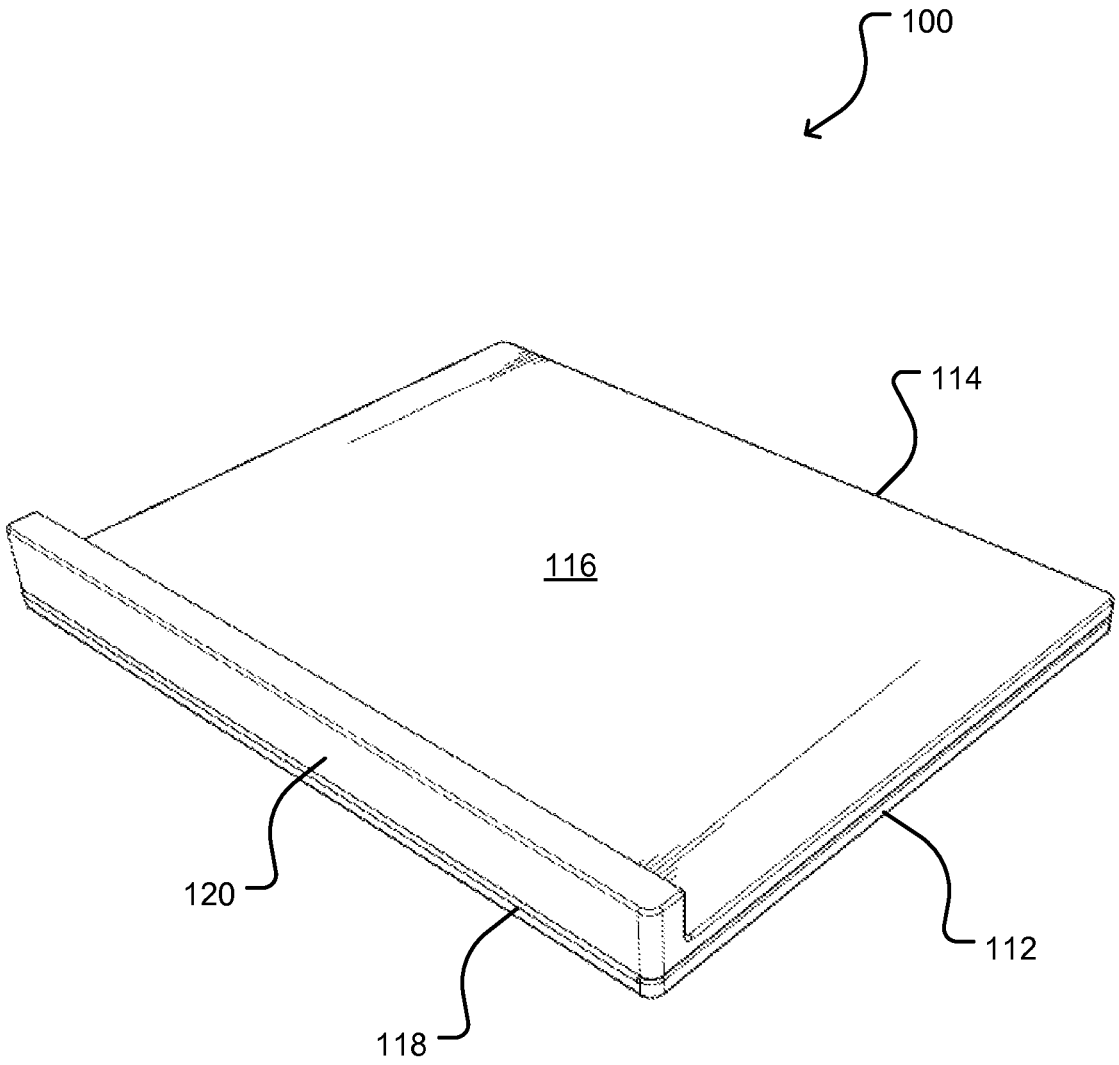
FIG. 8 is a front perspective view of a slant board in a collapsed configuration according to the embodiment shown in FIG. 7.
Figure 9:
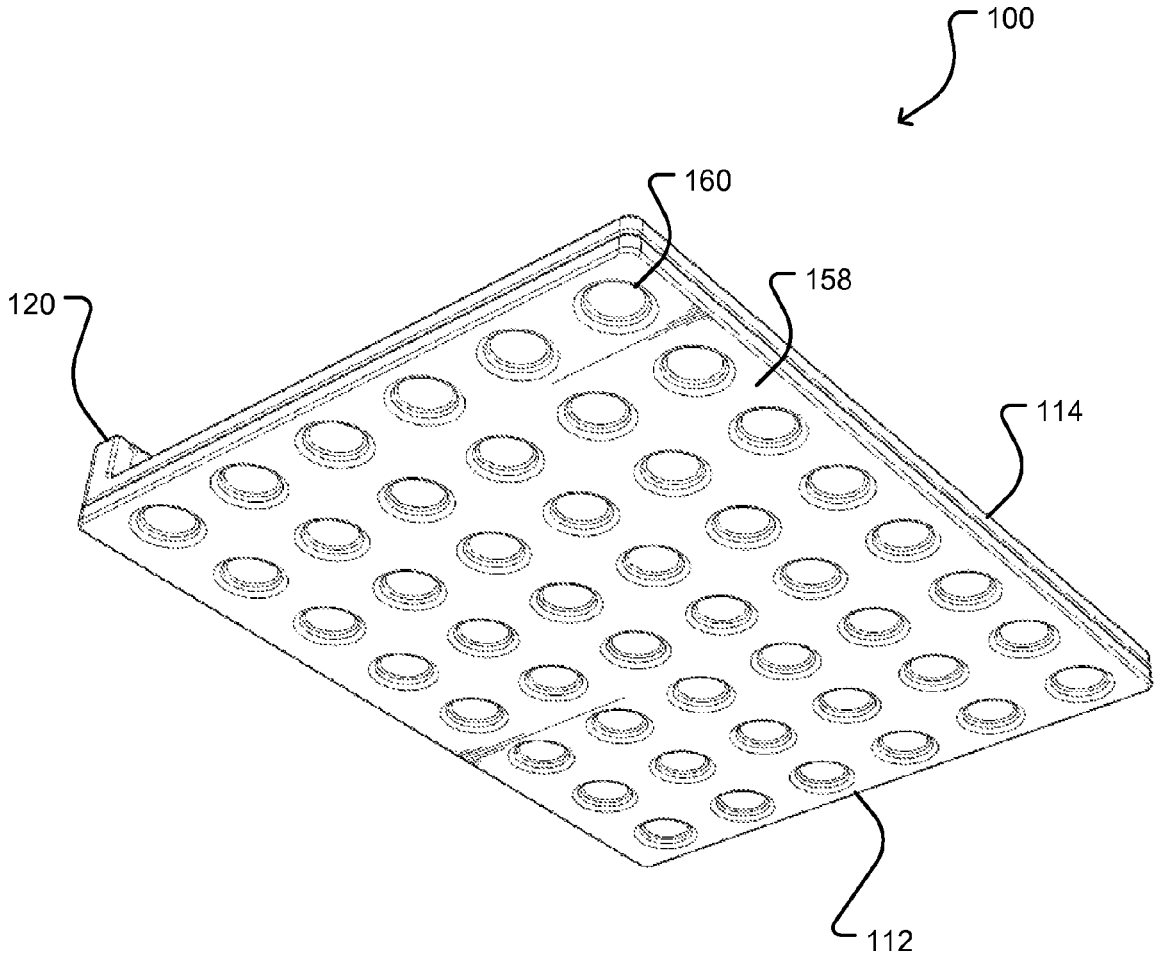
FIG. 9 is a bottom perspective view of a slant board in a collapsed configuration according to the embodiment shown in FIG. 7.
Figure 10:
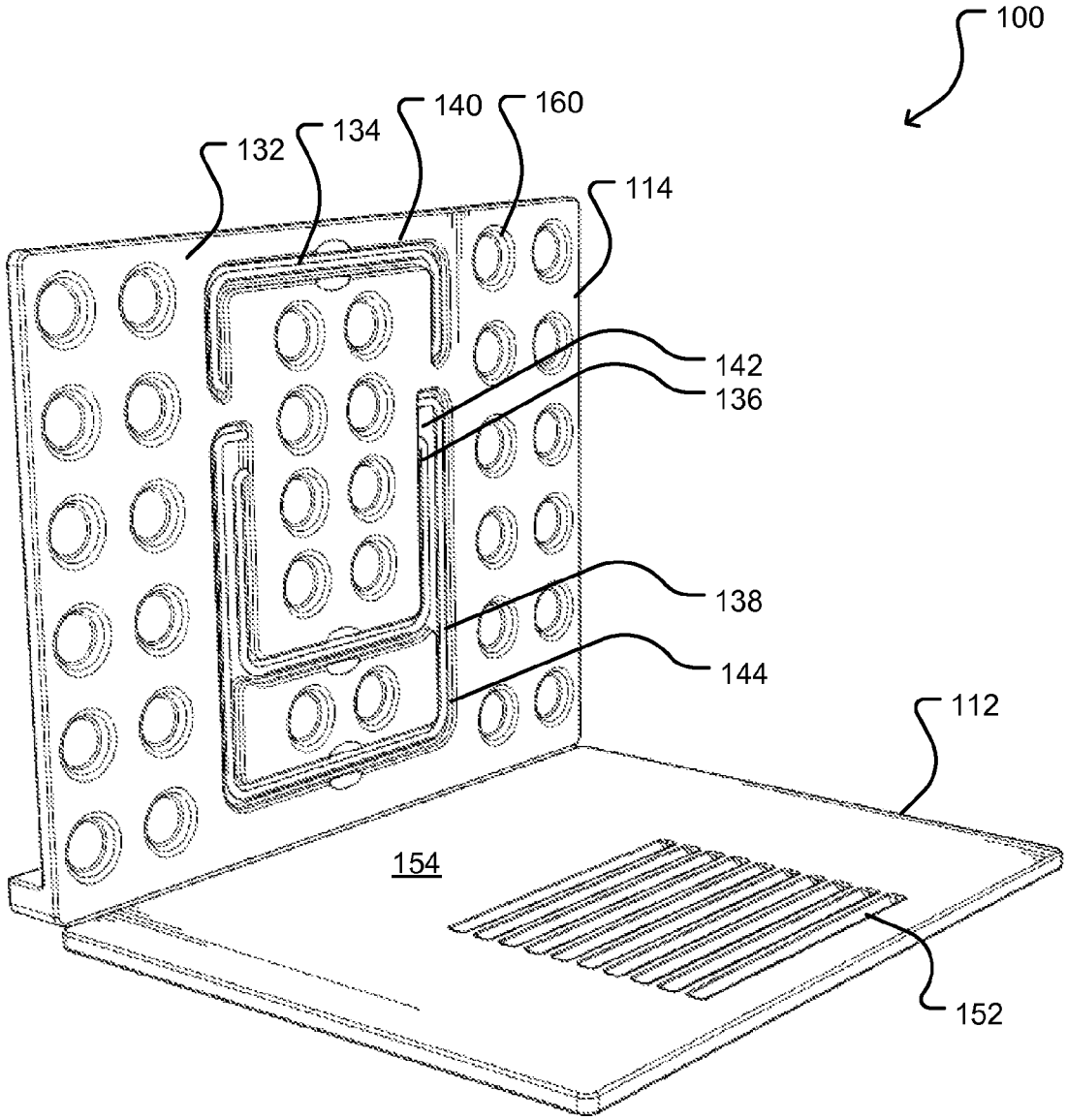
FIG. 10 is a back perspective view of a slant board in a partially deployed configuration according to the embodiment shown in FIG. 7.

Strut 38 is longer than strut 36. Strut 36 is longer than strut 34. Each of struts 34, 36, 38 are also positioned at different lateral pivot axes along the longitudinal extent of table 14. The different strut lengths and different lateral pivot axes of struts 34, 36, 38, together with the different positions of stops 52, allow struts 34, 36, 38 to selectively engage stops 52 in a variety of combinations. This provides a broader range of stable and secure tilt angles than known slant boards having only one strut. FIGS. 4 to 6 illustrate slant board 10 configured in exemplary tilt angles.

Providing shortest strut 34 at a relatively distal region of table 14 allows table 14 to be oriented at low tilt angles (e.g. FIG. 4). Providing longest strut 38 at about the midway region of table 14 allows table 14 to be oriented at high tilt angles (e.g. FIGS. 5 and 6). Providing medium length strut 38 at about the midway region of table 14 allows table 14 to be oriented at moderate tilt angles. In the illustrated embodiment, strut 34 provides tilt angles ranging from about 5 to 13 degrees, strut 36 provides tilt angles ranging from about 12 to 40 degrees, and strut 38 provides tilt angles ranging from about 35 to 58 degrees.

In some embodiments, two or more of the plurality of struts may be identical in length but positioned at different lateral pivot axes. In other embodiments, two or more of the plurality of struts may be of different lengths but provided at a common lateral pivot axis. Struts may be provided at a common lateral pivot axis by, for example, nesting shorter struts within longer struts.

Recesses 40, 42, 44 may include retaining means (not shown) for retaining struts 34, 36, 38 in the stowed position. In some embodiments retaining means may, for example, be magnets if the struts are metallic or are disposed with correspondingly positioned magnets themselves. In other embodiments, the attachment means may include clips and the like. In yet other embodiments the struts may be retained in recesses by friction fit.

In operation, slant board 10 is opened by lifting table 14 away from base 12. Struts 34, 36, 38 are deployed by manually grasping portions along the struts corresponding to cutouts 46, 48, 50 in inner face 32. Any one of struts 34, 36, 38 may be deployed from its stowed position in inner face 32 by manually grasping a portion of the strut adjacent the corresponding cutout in inner face 32. The chosen strut is swung out and selectively engaged with any one of stops 52 to provide a desired tilt angle for table 14. The object to be read, viewed or worked is placed on shelf 20 and against outer face 16. Retaining arms 22 may then be deployed by manually grasping portions of the retaining arms corresponding to cutouts 26, and telescoped outwardly from shelf 20. Retaining arms 22 are then rotated until fingers 28 are in a suitable position for holding the object. Retaining arms 22 are then released to allow the biasing means to urge retaining arms 22 and in particular fingers 28 to press against the object. After use, retaining arms 22 are pulled away from the object, rotated, and released into their stowed positions in slot 24. Table 12 is pulled toward the user to disengage the deployed strut from its stop. The struts are stowed in the recesses, and the table 14 is closed flat on top of base 12.

FIGS. 7 to 12 show a slant board 100 according to another embodiment of the invention. Slant board 100 is made of blow molded lightweight plastic. Slant board 100 includes a base 112, table 114, outer face 116, hinge 118, shelf 120, inner face 132, struts 134, 136, 138, recesses 140, 142, 144, stops 152, and inner face 154, each of which are similar in structure and function to identically-named features of slant board 10 shown in FIGS. 1 to 6.

Base 112 and table 114 are connected by a live hinge 118. One or more of inner faces 132, 154 and outer faces 116, 158 may be formed with dimples 160 or other texture features to provide strength and rigidity to slant board 100. Slant board 100 has a plurality of dimples 160 on inner face 132 and outer face 158.

Figure 11:
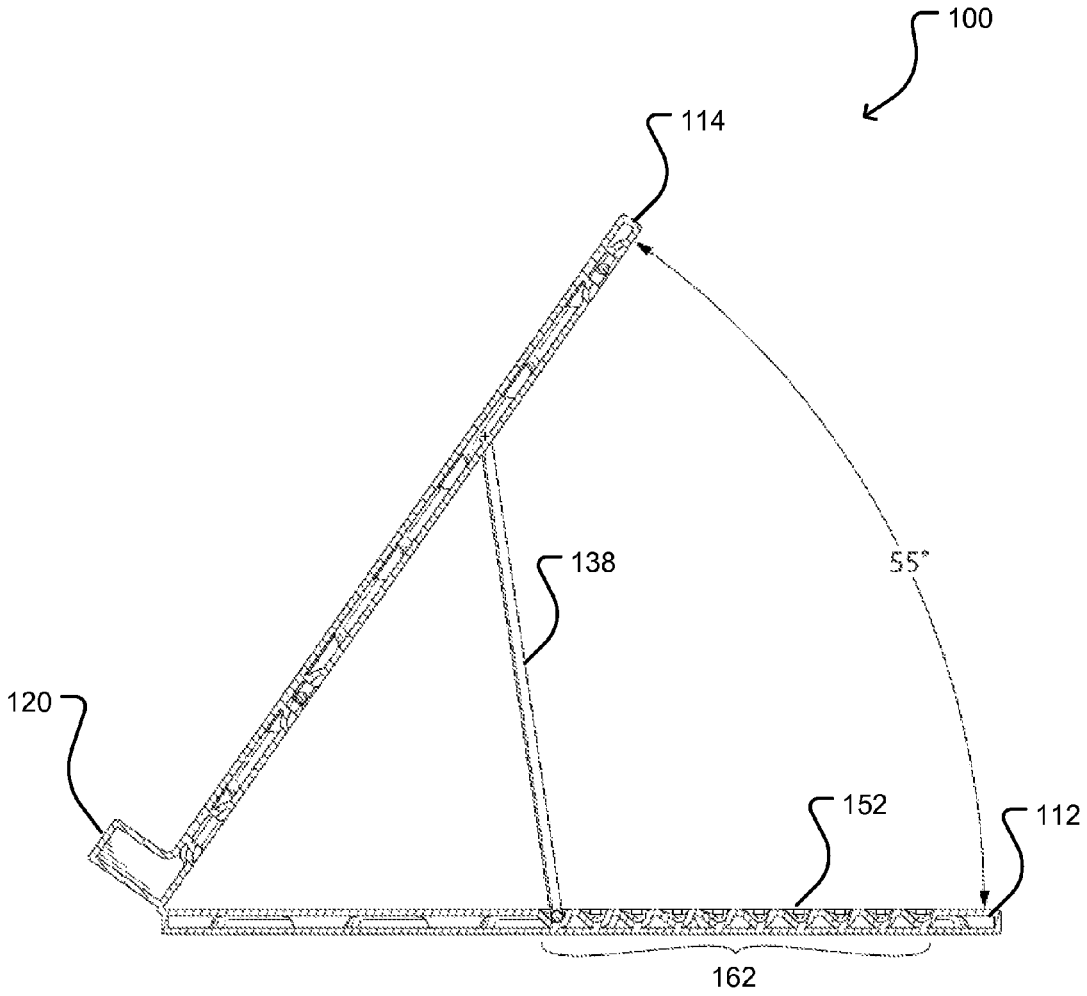
FIG. 11 is a side cross-sectional view of a slant board fully deployed at a maximum tilt angle according to the embodiment shown in FIG. 7.
Figure 12:
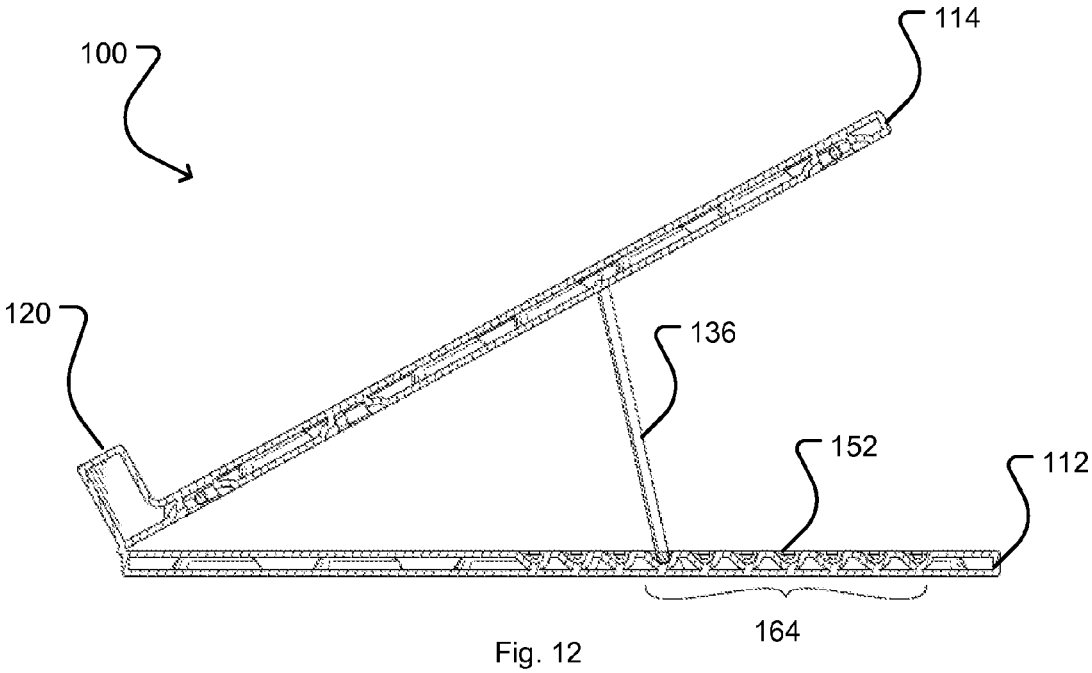
FIG. 12 is a side cross-sectional view of a slant board fully deployed at a medium tilt angle according to the embodiment shown in FIG. 7.
Figure 13:
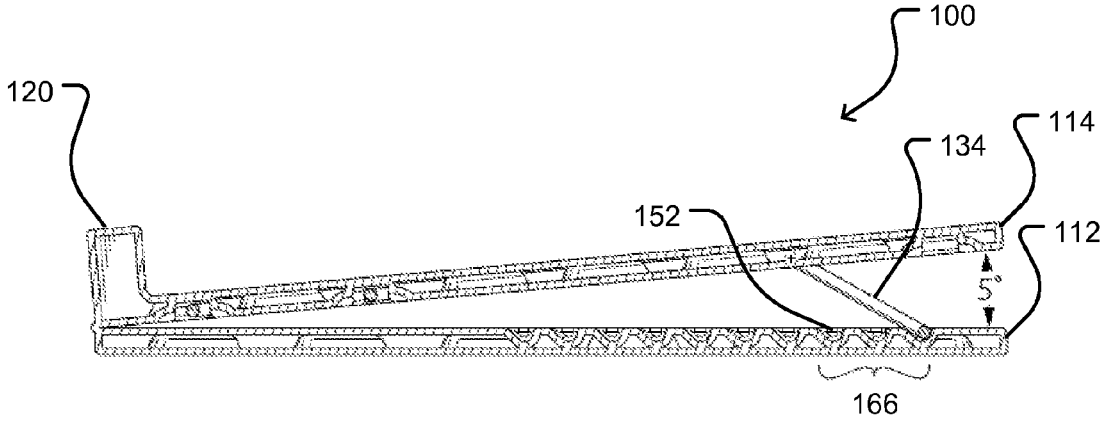
FIG. 13 is a side cross-sectional view of a slant board fully deployed at a minimum tilt angle according to the embodiment shown in FIG. 7.

Stops 152 of slant board 100 have ten positions. The first position refers to the most proximal stop 152 and the tenth position refers to the most distal stop 152, with the second through ninth positions therebetween. As shown in FIG. 11, large strut 138 may engage stops 152 at any of the ten positions of large strut stop range 162. As shown in FIG. 12, medium strut 136 may engage stops 152 at any of the fourth to tenth positions of medium strut stop range 164. As shown in FIG. 13, small strut 134 may engage stops 152 at any of the eighth to tenth positions. Accordingly, slant board 100 may be adjusted from a minimum tilt angle of about 5 degrees, when small strut 134 is engaged at the tenth position of stops 152, to a maximum tilt angle of about 55 degrees, when large strut 138 is engaged at the first position of stops 152.

As will be apparent to those skilled in the art in the light of the foregoing disclosure, many alterations and modifications are possible in the practice of this invention without departing from the spirit or scope thereof. For example:

- in some embodiments, the struts may be on the base and the stops may be on the table.
- in some embodiments, one or more first struts may be on the table and engageable with corresponding first stops on the base, and one or more second struts may be on the same base and engageable with corresponding second stops on the same table.

The invention claimed is:

1. A slant board comprising:

a table comprising:

an inner face;

an outer face;

a plurality of struts, each strut pivotally coupled at a first end to the inner face along respective lateral parallel arrayed pivot axes;

a base pivotally coupled to the table to define a tilt angle therebetween, the base comprising a plurality of parallel arrayed stops for engaging a second end of the struts;

wherein at least two struts have different lateral pivot axes and/or different lengths, whereby each of the plurality of struts is engageable with the plurality of stops to provide a range of tilt angles by pivoting the strut at the first end at the lateral pivot axis to cause the second end of the strut to swing into individual ones of the plurality of stops;

wherein the outer face comprises a shelf at a proximal end thereof;

wherein the plurality of struts comprises:

a first strut;

a second strut having a length greater than the first strut; and a third strut having a length greater than the second strut.

2. A slant board according to claim 1 wherein a lateral pivot axis of the first strut is disposed at a distal region of the inner face, a lateral pivot axis of the third strut is disposed proximally of the lateral pivot axis of the first strut, and a lateral pivot axis of the second strut is disposed proximally of the lateral pivot axis of the third strut.

3. A slant board according to claim 2 wherein the second strut is nestable within the third strut.

4. A slant board according to claim 3 wherein the inner face comprises a plurality of recesses for stowing the struts.

5. A slant board according to claim 4 wherein the the plurality of recesses comprise magnets for releasably engaging the struts.

6. A slant board according to claim 1 wherein the table and the base are of substantially similar size and dimension.

7. A slant board according to claim 1 wherein the table and the base are made of molded plastic.

8. A slant board according to claim 1 wherein the plurality of stops comprise laterally elongated grooves.

9. A slant board according to claim 8 wherein the plurality of stops are disposed in a recess in the base.

10. A slant board according to claim 1 wherein the shelf comprises a pair of retaining arms.

11. A slant board comprising:

a first board comprising:

an inner face;

an outer face comprising a shelf at a proximal region thereof;

a plurality of struts, each strut pivotally coupled at a first end to the inner face along respective lateral parallel arrayed pivot axes;

a second board pivotally coupled to the first board to define a tilt angle therebetween, the second board comprising a plurality of parallel arrayed stops for engaging a second end of the struts;

wherein at least two struts have different lateral pivot axes and/or different lengths, whereby each of the plurality of struts is engageable with at least one of the plurality of stops to provide a range of tilt angles by pivoting the strut at the first end at the lateral pivot axis to cause the second end of the strut to swing into individual ones of the plurality of stops the plurality of struts comprising:

a first strut;

a second strut having a length greater than the first strut.

12. A slant board according to claim 11 wherein a lateral pivot axis of the first strut is distal to a lateral pivot axis of the second strut.

13. A slant board comprising:

a table comprising:

an inner face;

an outer face comprising a shelf at a proximal end thereof;

a first U-shaped strut;

a second U-shaped strut having a length greater than the first strut;

a third U-shaped strut having a length greater than the second strut, wherein each strut is pivotally coupled at a first end to the inner face along respective lateral parallel arrayed pivot axes, wherein a lateral pivot axis of the first strut is disposed at a distal region of the inner face, a lateral pivot axis of the third strut is disposed proximally of the lateral pivot axis of the first strut, and a lateral pivot axis of the second strut is disposed proximally of the lateral pivot axis of the third strut;

wherein the second strut is nestable within the third strut;

wherein the inner face comprises a plurality of recesses for stowing the struts;

wherein the plurality of recesses comprise means for releasably engaging the struts, a base pivotally coupled to the table to define a tilt angle therebetween, the base comprising a plurality of laterally elongated parallel arrayed grooves for engaging a second end of the struts, wherein the table and the base are of substantially similar size and dimension, wherein the table and the base are made of blow-molded plastic;

whereby each of the struts is engageable with at least one of the plurality of laterally elongated grooves to provide a range of tilt angles by pivoting the strut at the first end at the lateral pivot axis to cause the second end of the strut to swing into individual ones of the plurality of stops.

14. A slant board according to claim 13 wherein the range of tilt angles ranges from about 5 degrees by engaging the first strut to one of the plurality of laterally elongated grooves to about 55 degrees by engaging the third strut to another one of the plurality of laterally elongated grooves.

15. A slant board according to claim 13 wherein the inner face of the table and an outer face of the base are dimpled.

* * * * *